United States Patent [19]

Heymann

[11] Patent Number: 4,812,105

[45] Date of Patent: Mar. 14, 1989

[54] BELL SEAL AND RETAINING NUT FOR HIGH PRESSURE TURBINES

[75] Inventor: Frank J. Heymann, Winter Springs, Fla.

[73] Assignee: Westinghouse Electric Corp., Pittsburgh, Pa.

[21] Appl. No.: 157,553

[22] Filed: Feb. 18, 1988

[51] Int. Cl.[4] ..... F01D 25/26

[52] U.S. Cl. ..... 415/134; 415/138; 277/72 R; 285/101

[58] Field of Search ..... 415/134, 136, 138, 139; 285/101, 102, 95; 277/72 R

[56] References Cited

U.S. PATENT DOCUMENTS 3,907,308 9/1975 Stock ..... 277/72 R
4,750,861 6/1988 Baker ..... 415/134

FOREIGN PATENT DOCUMENTS 619695 5/1961 Canada ..... 285/95
1576986 11/1970 Fed. Rep. of Germany ..... 415/138
3509359 8/1986 Fed. Rep. of Germany ..... 415/134

*Primary Examiner*—Robert E. Garrett
*Assistant Examiner*—John T. Kwon

[57] ABSTRACT

A bell seal unit and retaining nut for use in the nozzle chamber unit of an elastic fluid turbine, such as the steam turbine used to drive electrical utility generators. The bell seal unit includes a radial flange with an end face sealing surface and a skirt portion with a lower skirt margin subdivided into a labryinth seal region and a guiding and wear resisting region. The labryinth seal region includes plural, spaced apart circumferential seal lands and grooves, and the guiding and wear resisting region includes plural axial lands and grooves. The ball seal unit is positioned for free but limited axial movement by a retaining nut which includes a smooth inner cylindrical surface, a shoulder surface and a lower flange surface. Plural slots extend between the shoulder and flange surfaces to facilitate fluid flow to the lower surface of the bell seal radial flange.

15 Claims, 2 Drawing Sheets

BELL SEAL AND RETAINING NUT FOR HIGH PRESSURE TURBINES

BACKGROUND OF THE INVENTION

1. Field of the Invention.

The presention invention relates generally to specialty seals, and more particularly, to so-called bell seal assemblies forming parts of high pressure steam turbines used, for example, in generating electricity.

2. Description of the Prior Art.

While steam turbines of the kind used by electric utilities, for example, have been in use for a number of years and are recognized as a highly satisfactory method of power generation, the construction and arrangement of many turbines is such that they present difficult sealing problems in particular areas.

A typical steam turbine, wherein the high pressure section rotor is disposed within so-called inner and outer cylinders requires steam to pass without leakage between the cylinders. This requires a static seal which will withstand extremely high pressures, high temperatures, and differential thermal expansion; the seal must be substantially fluid-tight and remain stable under conditions of extremely high velocity, sometimes pulsating steam flow. Dynamic instability, vibration, and thermal shock are repeatedly encountered in use by bell seal assemblies. The present invention is directed to an improvement in seals of this type; one prior art version of such a bell seal is shown in U.S. Pat. No. 3,907,308.

By way of further background, a typical steam turbine unit includes a rotor assembly journaled for rotation about a given axis and surrounded by so-called inner and outer cylinders. The inner cylinder includes, among other parts, a blade carrier ring which forms a part of the turbine stator and several nozzle chamber units each welded to the inner cylinder so as to become an integral part thereof. The outer cylinder includes a high pressure steam exhaust outlet, and a number of so-called inlet sleeve units, each of which extends inwardly in telescoping relation to its associated nozzle chamber in the inner cylinder.

From each of the several control valves (not shown), the steam enters the high-pressure turbine through an inlet sleeve integrally attached to the outer cylinder, into a nozzle chamber integrally attached to the inner cylinder, and then passes through the nozzles and rotating blades of the control stage. At this point, the steam from the several parallel inlet paths merges together and then flows through the rest of the high-pressure turbine blading comprised of an array of stationary and rotating blade rows.

The bell seal assembly forms the connection between the inlet sleeve and its associated nozzle chamber, accommodating some relative motion and misalignment between them while simultaneously sealing against leakage of the supply steam entering the turbine into the space between the outer and inner cylinders which contains steam at a considerably lower pressure.

Because of the nature of the fluid flow, in a typical case being steam at pressures ranging from 2400 to 3500 p.s.i., generally at temperatures of 1000° F., there are problems of thermal shock, thermal expansion, and manufacturing alignment tolerances, which mandate that a highly versatile seal be provided. Further, the seal must also remain stable under conditions of pulsating pressure, and must resist vibration, wear and loss of effective sealing contact in use.

In many prior art sealing application, a bell type seal has generally been settled upon as standard. The characteristic bell or flanged cylinder shape of the seal is such that it may be positioned and retained relative to the inlet sleeve forming a part of the outer cylinder by a special retaining nut which in turn allows the seal the predetermined amount of "float", or free but limited movement, which is required for proper centering and sealing action.

In the upper half of the turbine cylinder, the flange of the bell seal unit is retained by an upwardly directed shoulder surface portion of the retaining nut and a lower end face sealing surface on the inlet sleeve. The skirt of the bell seal extends in a downstream direction and enters a skirt-receiving annular groove formed in the nozzle chamber. In use, high pressure in the inlet sleeve passage serves to move the bell unit slightly axially upstream into the end face sealing relation just described. The lower margin of the skirt expands thermally into a generally fluid-tight contact with an oppositely directed cylindrical sealing surface of the nozzle chamber annulus.

While this general arrangement has been known and is considered perhaps the most satisfactory, like all other difficult sealing installations, it is considered capable of still further improvement. Because of the conditions under which the turbine is operated, the seal assembly is exposed to severe temperature diffentials, extreme pressure gradients and rapid pressure fluctuations. When these forces cause leakage around the seal periphery, transient pressures cause misalignment, noise, chatter and, very often, a resonant movement of the parts relative to each other in the seal region. These problems can cause accelerated sealing failure, particularly where the surfaces are damaged by the resulting vibration. In some cases, vibration is so extreme that loud noise is created, and abrasion of the bell skirt and the nozzle chamber wall results. Ultimately, this may result in cracks and fissures in the bell seal or elsewhere in the inlet sleeve or the nozzle chamber.

Unfortunately, however, the clearances allowing this movement may not simply be eliminated. The bell must be free to move axially to create the proper end face seal, to move radially for alignment, and to expand radially to create the peripheral side wall seal which will withstand the extreme pressures and thermal gradients referred to. During shutdowns, after extended use for maintenance or otherwise, the parts must "shrink" to a thermally relaxed condition which will provide sufficient clearance for the inner and outer cylinders to be removed from each other without damage. These seals or other components may then be replaced and re-installed as needed.

In view of the failure of the prior art to provide a completely satisfactory seal, it is a general object of the present invention to provide an improved bell seal assembly.

Another object of the invention is to provide a bell seal assembly using a bell seal having a particular arrangement of lands and grooves which isolate the guiding and locating function from the wall-to-skirt primary sealing function so both of these functions can be better achieved and maintained.

A further object of the invention is to provide a seal which is capable of improved performance without requiring materials which are more expensive or difficult to work with than those presently in use.

A still further object of the invention is to provide a seal which will provide improved functioning without measurably increased cost of manufacture.

Another object of the invention is to provide a bell seal having a retaining nut unit with a novel support arrangement for the bell seal flange.

A still further object of the invention is to provide a combination retaining nut and bell seal wherein the retaining nut includes a flange seal support element having a plurality of slots extending axially from its lower flange end surface to its flange support surface to provide improved pressure equalization on the flange of the bell seal, and also to provide engagement surfaces for the nut adjusting tool used to position the bell unit.

A further object of the invention is to provide a seal assembly which includes a bell having a skirt portion with its lower margin subdivided into a labyrinth seal region of land and groove configuration and a guiding and locating region having guide lands and grooves extending axially between the lower skirt end portion and an area adjacent the labyrinth seal region, which is in turn comprised of a plurality of circumferentially extending, sidewall engaging lands spaced apart by circumferential grooves.

A still further object of the invention is to provide a bell seal assembly wherein portions of the retaining nut and the nozzle chamber are shaped to provide a seal cavity of a desired contour between them for improved dynamic flow and reduced excitation caused by steam pressure variations in the inlet sleeve and the seal cavity.

Yet another object is to provide a seal having a retaining nut with a smooth, inner surface and an uninterrupted lower edge, which is smoothly contoured for reduced cavity turbulence in use.

These and other objects and advantages of the invention are achieved and practiced by providing a bell seal assembly having a bell unit with a radially extending flange having an upwardly directed end face sealing surface and a downwardly directed flange support surface, a skirt portion with a lower margin subdivided into a labyrinth seal region and a grooved guide surface region, with the retaining nut including a support flange having axial grooves in its outer diameter to provide a fluid flow path between the downstream end face of the nut flange and the support surface of the bell flange. The manner in which these and other objects and advantages of the invention are achieved in practice will become more clearly apparent when reference is made to the following detailed description of the preferred embodiment of the invention set forth by way of example, and shown in the accompanying drawings, and where like numbers indicate corresponding parts throughout the several figures.

DESCRIPTION OF THE PREFERRED EMBODIMENTS OF THE INVENTION

While it will be understood that the seal of the invention may be used in various applications, a preferred form of seal will be described wherein the seal extends between portions of the inner an outer cylinders of a high pressure steam turbine of the type customarily used in public utility applications. Likewise, while the drawings illustrate a form of seal wherein the skirt portion of the bell is directed downwardly, and the flange is on the top, and wherein the steam flow enters the turbine from the top, and flows downwardly from the outer to the inner cylinder, these parts might be positioned in any orientation. In the following specification, and in the claims, therefore, unless specifically indicated otherwise, the expression "upper" means lying toward or facing the upstream direction of steam flow, and "lower" means lying toward or facing the downstream direction of steam flow.

Figure 1:
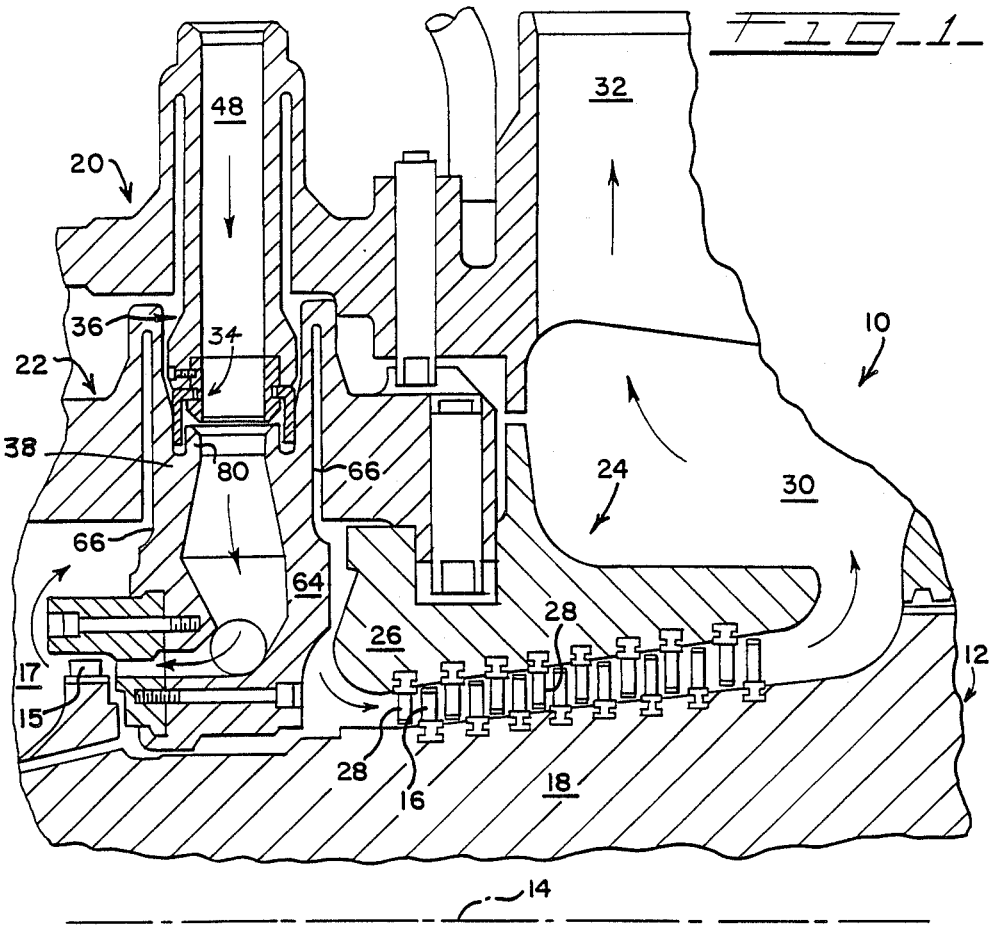
FIG. 1 is a fragmentary vertical sectional view showing certain major elements of a steam turbine with which the novel bell seal assembly of the invention is associated in use.

Referring now to the drawings in greater detail, FIG. 1 shows a portion of a high pressure turbine assembly generally designated 10 and shown to include, as one of its principal elements, a rotor assembly generally designated 12 and mounted for rotation about a center line 14. The rotor assembly 12 carries a plurality of rotor blades 16 affixed to the rotor body 18 and arranged in rows of gradually increasing diameter.

Another principal element is a so-called outer cylinder assembly generally designated 20, which is concentrically disposed with respect to an inner cylinder assembly generally designated 22, to which detailed reference is made elsewhere herein. The inner cylinder assembly 22 positions a stator assembly generally designated 24 and shown to include an annular blade carrier ring 26. The ring positions a plurality of fixed stator blades 28 which are interleaved with their counterpart blades 16 on the rotor 12 in a manner well-known to those skilled in the art. A row of so-called control stage blading 15 is also affixed to the rotor 18. After steam passes through this blading 15, it is directed from the chamber 17 around the nozzle chamber 38 and then through the rows of blades 16, 28 comprising the various stages of the high pressure turbine.

As is also shown, a steam outlet annulus 30 is formed between the inner and outer cylinders 22,20. In use, steam passes in the direction shown in FIG. 1 by the arrows between the stator 24 and the rotor 12, passing through the succession of blade rows 16,28 on its way to the outlet annulus 30 for collection of high pressure steam. Steam passing through annulus 30 is directed to means in the form of an outlet 32 which, as is known to those skilled in the art, may lead the steam back to the reheater section of the steam generator. Thereafter, the steam returns to the turbine and may pass through an intermediate pressure turbine element and a low pressure turbine element, finally exhausting to the condenser.

FIG. 1 also shows that a seal assembly generally designated 34 and embodying the inventive concept is provided for the purpose of making an effective seal between appropriate portions of the inlet sleeve unit generally designated 36, forming a part of the outer cylinder 20, and parts of the nozzle chamber, generally designated 38, which is welded to or otherwise integrally attached to the inner cylinder 22. It is the relative movement of these elements under thermal expansion and high pressure steam flow which dictates the severe requirements for the seal of the invention.

Figure 3:
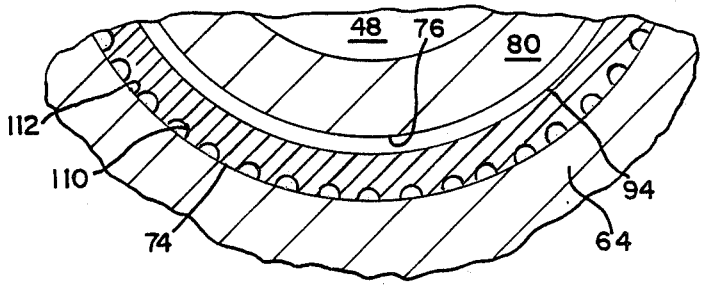
FIG. 3 is a fragmentary horizontal section view of the bell seal unit and parts of the nozzle chamber of FIG. 2, taken along lines 3—3 thereof.
Figure 4:
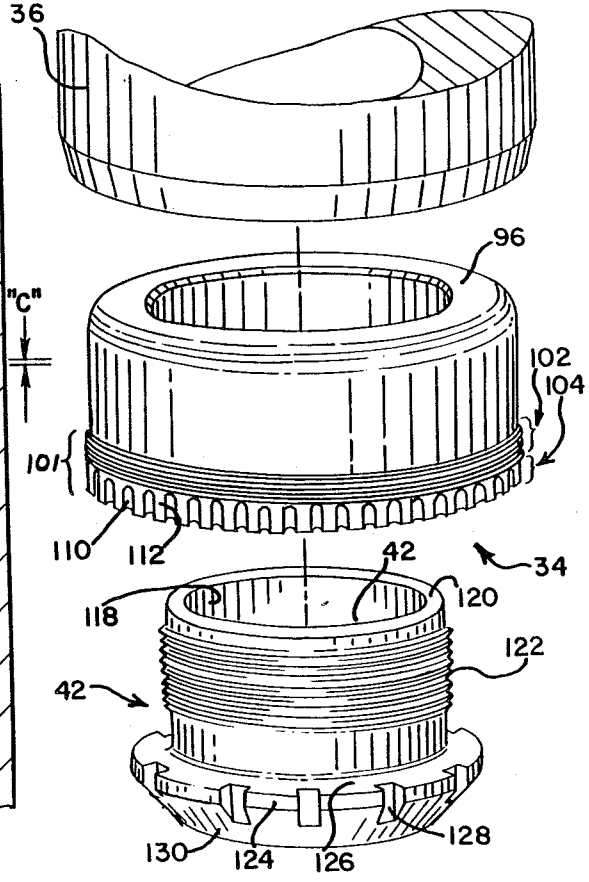
FIG. 4 is an exploded perspective view showing portions of the inlet sleeve, the retaining nut and the bell seal unit prior to assembly thereof.
Figure 2:
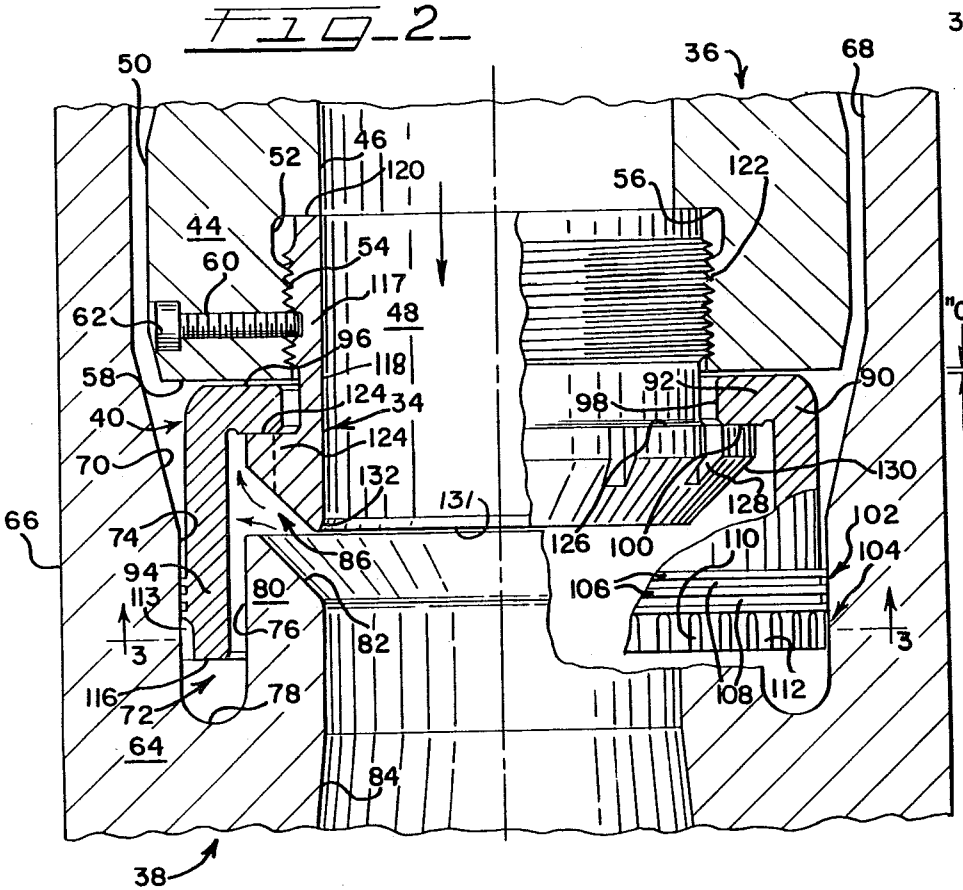
FIG. 2 is an enlarged view, partly in section and partly in elevation, showing the construction of the bell seal assembly of the invention.

Referring now in particular to FIGS. 2–4, the seal assembly 34 per se is shown to include two principal elements, a bell seal unit generally designated 40 and a retaining nut unit generally designated 42. In use, the retaining nut positions the bell seal with respect to the particular areas of the inlet sleeve 36 and the nozzle chamber 38 which are necessary to provide not only the sealing surfaces, but which will also accommodate the movement which necessarily takes place between these associated parts. In this connection, the seal of the invention may be thought of as a static seal in the sense that there is no repeated rotary or long travel oscillating motion between parts. However, there is definite radial growth of the bell seal skirt, and definite axial movement of the bell as a whole in response to the internal pressure which is necessary to operate the turbine. In bell seals, this pressure is taken advantage of to insure that a positive seal is formed. The bell may also shift radially for alignment purposes.

In the preferred construction shown, the inlet sleeve 36 includes a main sleeve body 44 with a generally cylindrical, smooth inside diameter surface 46 defining a main inlet passage 48 for incoming steam which in use moves within the passage 48 in the direction of the arrows in FIGS. 1 and 2. The sleeve body 44 also includes an outer diameter surface 50, and a counterbore 52 defined in part by screw threads 54 extending between a contoured shoulder 56 at the upstream end of the counterbore 52 and a machined bottom end face sealing surface 58 at the bottom or downstream end thereof.

As shown, means for locking the retaining nut 42 in a fixed position of adjustment are provided in the form of a radially extending tapped opening 60 which removably receives a threaded locking fastener 62.

Referring now to the nozzle chamber 38, FIG. 2 shows this unit to include a main body portion 64 having a generally cylindrical outside diameter surface 66, a major diameter, sleeve-receiving surface 68, a tapering shoulder surface 70 and a skirt-receiving annular groove generally designated 72 and shown in turn to be formed by an outside diameter sidewall sealing surface 74, an inside diameter sidewall 76, and a contoured bottom wall 78.

These elements define a neck portion 80 in the nozzle chamber 38. The neck portion 80 also preferably includes a beveled end surface 82 and an innermost sidewall surface 84 forming a continuation of the inlet passage 48 for the steam. The seal cavity as a whole, generally designated 86 in FIG. 2, thus comprises the space between adjacent parts of the nut 42 and the neck 80.

Referring now to the elements of the seal assembly per se, this unit 34 includes a bell generally designated 40, having a body 90, formed of a radially inwardly extending flange portion 92 and a depending skirt portion 94.

As best shown in FIGS. 2 and 4, the flange 92 includes a radially extending, machined upper end face sealing surface 96 disposed in facing relationship to the inlet sleeve surface 58, an axially extending inside diameter surface 98 and a lower support surface 100 which is adapted to engaged for positioning the bell 40, as will appear.

Referring now the skirt portion 94 of the bell unit 40, this unit is shown to include a lower margin 101 which is subdivided into a labyrinth seal region generally designated 102 and a wear-resisting and guiding surface area portion generally designated 104. The sealing region 102 includes a plurality of circumferentially extending sealing lands 106 separated by circumferential grooves 108, while the wear-resisting and guiding surface area 104 includes a plurality of axially extending grooves 110 having formed therebetween a plurality of raised guide lands 112. In the preferred form, the axial grooves 110 terminate in a circumferential groove adjacent to the labyrinth seal region 102. The axial grooves 110 may have tapered end portions 113 to facilitate machining or to avoid cutting into the sealing lands 106.

Referring now to the other major element of the novel seal unit, the retaining nut unit 42 is shown to include a plurality of elements including a retaining nut body 117 having a smooth inside diameter surface 118, a flat end face 120 disposed oppositely to and in some cases engaging the sleeve shoulder 56. The nut 42 includes a threaded outside diameter surface 122 which cooperates with the threads 54 formed in the inlet sleeve counterbore 52.

The downstream portion of the nut 42 includes a slotted annular radial support flange 124 having means in the form of a partially serrated or indented shoulder surface 126 adapted to engage and position the collar 92 of the bell 40 by engaging its lower flange surface 100.

A plurality of axially extending slots 128 are formed in the flange 124; the slots 128 extend between the upper surface 126 and the lower surface 130 of the nut 42. The lower surface 130 is preferably of frustoconical form; its trailing edge 13 is circumferentially continuous and meets a beveled margin 132 of the surface 118.

An important feature of the invention is that the slots 128 in the nut 42 which extend through the nut flange 124 between the lower surface 130 of the nut 42 and the upper support flange surface 126 provide plural passages for high pressure steam to act directly on the lower surface 100 of the bell flange 92. This increases the flange surface area available for exposure to high pressure steam for seating the bell seal upper surface 96 against inlet sleeve surface 58.

Moreover, axial slots 128, which in prior art extended radially of the nut, while still utilized to position a wrench for adjusting the clearance or head space between the two primary sealing surfaces 58, 96 now serve an additional purpose.

Because the slots 128 are located on the outer diameter of the retaining nut, the lower or trailing edge 132 of the nut 42 may be made smooth and continuous and thus be free from the slots or other interruptions which would cause excessively turbulent flow in this area. This feature, combined with shaping the lower surface 130 of the nut 42 into frustoconical form, preferably at an angle which is substantially parallel to that of the beveled surface 82 on the nozzle chamber neck 80, provides a seal cavity of reduced tendencies toward cavity excitation and resonance.

Referring now to the assembly of the seal for use, when the turbine unit is to be assembled, the lower part of the inner cylinder is positioned relative to the rotor in a known manner, and the upper half of the inner cylinder 22 is then positioned over the lower half with the stator and rotor blades interleaved. The upper half of the inner cylinder 22 is then affixed to the lower half of the inner cylinder. This then leaves one or more nozzle chamber portions which are then disposed in facing relation to the outer cylinder prior to assembly of these parts. Before this assembly is completed, however, and referring specifically to FIG. 4, the bell unit 40 is positioned over and supported on the retaining nut 42, and the nut and bell seal are raised as a whole into the position shown in FIGS. 1 and 2 relative to the lower or outlet portion of the inlet sleeve 36. Then, the retaining nut threads 122 are engaged with their counterparts 54 on the inlet sleeve body 44 and the nut 42 is rotated until a pre-calculated clearance, preferably about 0.1 mm (0.004 inches) is provided between the opposed faces 96, 58 of the bell seal flange 92 and the inlet sleeve body 44. The locking fastener 62 is then secured to prevent further movement of the retaining nut 42. At this point, the outer cylinder 20 is guided into position over the inner cylinder 22 with the sleeve 36 and the chamber 38 aligned such that the seal skirt registers with the annulus 72 in the nozzle chamber body 64.

As the parts are assembled, there will be a very slight working clearance or at most a slight interference fit between the lands 112 and 106, and the inner sealing surface 74 of the nozzle chamber body 64. When the outer cylinder 20 rests securely in its proper position overlying the inner cylinder 22 and the fasteners (not shown) are fully tightened and locked, the bell seal assembly 34 will have the approximate orientation shown in FIG. 2. Preferably, the 0.1 mm free play or clearance "C" shown in FIG. 2 will appear as shown, provided gravity draws the bell unit downwardly.

When it is time for operation of the turbine, appropriate steam valves are manipulated and high pressure steam flows through the passage 48 in the inlet sleeve and through the turbine 10, as indicated by the arrows in FIG. 1. The pressurized steam in the inlet passage 48 tends to escape therefrom about the periphery of the bell unit 40. However, the pressure beneath and radially inside of the seal has two effects which act to prevent leakage. The first is that the steam pressure inside the chamber acts on the radial surface 100 of the bell flange, pushing it axially upwardly or upstream, thus urging the entire bell seal body 90 as a whole upwardly toward fluid-tight engagement of the opposed faces 58, 96. The steam pressure within the skirt of the bell unit tends to bow or bend the skirt 94 outwardly, and the combination of this force and with thermal expansion forces the lands 106 and 112 on the lower skirt margin 101 into fluid-tight engagement with the seal-receiving annular groove 72 and the sidewall 74.

The guide lands 112 not only assist in centering the bell seal relative to the annular groove 72 upon initial contact between the lands 112 and the groove sidewall 74, but this construction feature also has an additional advantage as well. While the invention is not to be taken as limited to any particular theory or principle of operation, it is believed likely that providing a mechanical centering of the bell skirt by using guide lands and grooves creates a more stable and effective seal.

In the prior art, where the lowermost portion of the skirt was sealed, intermittent leakage would cause irregular or uneven skirt movement, vibration, and even undesired resonance of these parts as the steam was permitted to escape intermittently. This was believed to be caused by the fact that pressure drop and skirt positioning were controlled by the same elements of the bell seal. With the present construction, these functions are separated and the axial lands and grooves 112, 110 provide the positioning of the skirt while the sealing lands and grooves 106, 108 control pressure drop. Leakage, if any, occurs through the labyrinth as a relatively controlled, gradual pressure drop rather than being characterized by a series of intermittent or sudden pressure drops.

Referring now the last feature of the invention, the portions of the seal cavity 86 lying between the beveled end surface 82 of the neck 80 and the lower flange surface 130 of the nut 42 form an angled gap rather than a transverse gap. This is intended to reduce the propensity of the pressure fluctuations in the inlet passage to fluctuate, or to reduce the magnitude of such fluctuations. The 45° angle of the gap surfaces is presently preferred, but other angles may prove more advantageous. The continuous trailing edge 130 of the nut is also shown as having a slight bevel, the length and angle of which may be varied depending upon pressure, velocity, and other steam conditions within the passage 48.

Referring now to the materials used in making the seals of the invention, and to make the associated turbine parts, the seals are customarly made from alloy steel materials which resist thermal shock and have carefully controlled expansion properties. Preferably, the coefficient of the thermal expansion of the bell seal should be slightly greater than that of the surrounding parts so that the seal will "grow" into tighter sealing engagement at the elevated temperatures encountered in turbine use, and "shrink" for removal and replacement at room temperature. These coefficients need not be large, however, in view of the 1000° F. temperatures normally characterizing the high pressure steam operating the turbines.

A typical inlet sleeve is preferably a forged steel alloy with a content of a 2.25% Cr and 1.0% W. The outer cylinder is an alloy casting having a content of 1.25% Cr, and 0.5% W. The bell seal itself is a cobalt-chromium-tungston-based alloy, preferably with 40–47 Rockwell "C" hardness; such material is available under the trade designation "Stellite 6". This alloy is typical of materials used in valve seats, for example, and has moderate hardness, thermal expansion greater than that of the surrounding components, high temperature strength and good resistance to thermal shock.

While reference is made to steam as the medium used to supply energy for operating the turbine, it is understood that the invention might also find application with other pressurized fluids, such as hot air, or other hot gases. Hence, the generic expression "elastic fluid" is sometimes used here and in the claims to describe steam or other such fluid.

It will thus be seen that the present invention provides a turbine with a novel seal unit having a number of novel advantages and characteristics, including those referred to specifically herein and others which are inherent in the invention. A preferred form of seal unit of the invention having been described in detail, by way of example, it is anticipated that the variations in the described form of construction may occur to those skilled in the art, and that such variations may be made without departing from the spirit of the invention or the scope of the appended claims.

What is claimed:

1. A bell seal assembly comprising, in combination, a bell seal unit and a retaining nut unit, said bell seal unit including a radially inwardly extending flange with an upper end face sealing surface, a lower flange support surface, and a generally cylindrical skirt portion depending from said flange and including a lower skirt margin terminating in a skirt end surface, said lower skirt margin having its radially outer surface subdivided into a labyrinth seal region and a guiding and wear resisting region, said labyrinth seal region including plural, spaced apart seal lands separated by circumferentially extending seal grooves, and said guiding and wear resisting region comprising a plurality of alternating guide lands and grooves extending axially inwardly from said skirt end surface, said sealing lands and said guide lands being adapted in use to be spaced closely apart by no more than a working clearance from an adjacently disposed, radially inwardly directed sidewall sealing surface of a turbine nozzle chamber when said seal is at a given, lower temperature and to be urged into snug radial sealing engagement with said sealing surface of said nozzle chamber when said nozzle chamber and said seal are at an elevated temperature, said bell unit being positioned by said retaining nut for free but limited axial movement such that said upper end face sealing surface is spaced just apart from a cooperating bottom end face sealing surface on an associated inlet sleeve, but is movable to a position of end face engagement with said inlet sleeve lower end face surface in response to an increase in fluid pressure in the interior or said seal assembly.

2. A bell seal assembly as defined in claim 1 wherein said retaining nut unit includes an exteriorly threaded portion forming a part of its outer diameter, said nut further including a smooth cylindrical inner diameter surface portion having a continuously extending, slightly beveled lowermost, margin.

3. A bell seal assembly as defined in claim 1 wherein said retaining nut for positioning said bell unit includes a radial support flange defined by an upper shoulder surfaces and a lower flange surface, said lower flange surface being of generally frustoconical configuration and tapering radially inwardly toward its inner diameter.

4. A bell seal assembly as defined in claim 1 wherein said retaining nut for positioning said bell seal unit includes a radial flange defined by an upper shoulder surface and a lower flange surface, said flange having a plurality of slots extending between said shoulder surface and said lower flange surface to provide plural passages so that fluid may pas through said slots to exert an upwardly directed force on said flange support surface of said bell seal unit.

5. A bell seal assembly as defined in claim 4 wherein said lower flange surface of said retaining nut is of generally frustoconical configuration and arranged so as to taper radially inwardly toward its inner diameter.

6. A bell seal assembly as defined in claim 1 wherein said grooves lying between said guide lands on said bell seal skirt include upper ends tapering toward a reduced depth as said grooves approach said seal land region.

7. A bell seal assembly comprising, in combination, a bell seal unit and a retaining nut unit, said bell seal unit including a radially inwardly extending flange with an upper end face sealing surface, a lower flange support surface, and a generally cylindrical skirt portion depending from said flange and including a lower skirt margin terminating in a skirt end surface, being adapted in use to be spaced closely apart by no more than a working clearance from an adjacently disposed, radially inwardly directed sidewall sealing surface of a turbine nozzle chamber when said seal is at a given, lower temperature and to be urged into snug radial sealing engagement with said nozzle chamber wall when said nozzle chamber and said seal are at an elevated temperature, said bell unit being positioned by said retaining nut for free but limited axial movement such that said upper end face sealing surface is spaced just apart from a cooperating bottom end face surface on an associated inlet sleeve, but is movable to a position of end face engagement with said inlet sleeve bottom end face surface in response to an increase in fluid pressure in the interior or said seal assembly, said retaining nut including a nut body having a smooth, cylindrical inside diameter surface, means adjacent the upper end thereof for permitting removable attachment of said nut to the interior of an associated turbine inlet sleeve, bell seal unit support and positioning means in the form of a radial flange defined by upper shoulder surfaces and a lower flange surface, said flange having a plurality of slots extending between said shoulder surface and said lower flange surface to define plural fluid passages, whereby said fluid may pass through said slots to exert an upwardly directed force on said bell seal radial flange to urge said bell seal unit into a position of snug sealing engagement between its upper end face sealing surface and the lower end face sealing surface of said inlet sleeve.

8. A bell seal assembly as defined in claim 7 wherein said lower flange surface of said retaining nut is of generally frustoconical form, said surface tapering radially inwardly toward the inner diameter of said nut.

9. A bell seal assembly as defined in claim 7 wherein the lowermost portion of said cylindrical inside diameter surface of said retaining nut is a continuous surface having a slight, radially outwardly extending bevel forming a part thereof.

10. A bell seal assembly as defined in claim 7 wherein said lower skirt margin includes a plurality of circumferentially extending, alternating lands and grooves forming a labyrinth seal portion of said skirt, the lowermost part of said skirt margin including circumferentially spaced axially extending guide lands and grooves.

11. A bell seal assembly comprising, in combination, a bell seal unit and a retaining nut unit, said bell seal unit including a radially inwardly extending flange with an upper end face sealing surface, a lower flange support surface, and a generally cylindrical skirt portion depending from said flange and including a lower skirt margin terminating in a skirt end surface, said lower skirt margin having its radially outer surface subdivided into a labyrinth seal region and a guiding and wear resisting region, said labyrinth seal region including plural, spaced apart seal lands separated by circumferentially extending seal grooves, and said guiding and wear resisting region comprising a plurality of alternately lands and grooves extending axially inwardly from said skirt end surface, said sealing lands and said guide lands being adapted in use to be spaced closely apart by no more than a working clearance from an adjacently disposed, radially inwardly directed sidewall sealing surface of a turbine nozzle chamber when said seal is at a given, lower temperature and to be urged into snug radial sealing engagement with said sealing surface of said nozzle chamber when said nozzle chamber and said seal are at an elevated temperature, said bell unit being positioned by said retaining nut for free but limited axial movement such that said upper end face sealing surface is spaced just apart from a cooperating bottom end face surface on an associated inlet sleeve, but is movable to a position of end face engagement with said inlet sleeve lower end face surface in response to an increase in fluid pressure in the interior or said seal assembly, said retaining nut including a nut body having a smooth, cylindrical inside diameter surface, means adjacent the upper end thereof for permitting removable attachment of said nut to the interior of an associated turbine inlet sleeve, bell seal unit support and positioning means in the form of a radial flange defined by an upper shoulder surfaces and a lower flange surface, said flange having a plurality of slots extending between said shoulder surfaces and said lower flange surface to define plural fluid passages, whereby said fluid may pass through said slots to exert an upwardly directed force on said bell seal radial flange to urge said bell seal unit into a position of snug sealing engagement between its upper end face sealing surface and said bottom end face sealing surface of said inlet sleeve.

12. In an elastic fluid turbine having a turbine rotor assembly, said turbine further including an inner cylinder unit surrounding said rotor assembly and an outer cylinder unit surrounding said inner cylinder unit, said inner cylinder having at least one nozzle chamber intergrally affixed thereto, said nozzle chamber including a seal-receiving annular groove and said outer cylinder including at least one inlet sleeve intergrally attached thereto, said inlet sleeve having a bottom end face sealing surface and being adapted to be received in telescoping relation to said nozzle chamber in said inner cylinder, and a bell seal assembly carried by said inlet sleeve and adapted to engage portions of said inlet sleeve and said nozzle chamber respectively in fluid-tight sealing engagement, said bell seal assembly comprising a bell seal unit and a retaining nut removably received within the inside diameter of said inlet sleeve and positioning said bell seal unit for free but limited movement therein, with said bell seal unit including a radial flange and a generally cylindrical skirt portion depending thereform, and an upper end face sealing surface on said flange, said end face surface being movable into snug sealing contact with said inlet sleeve end face surface, the improvement comprising said lower skirt margin having its radially outer surface subdivided into a labyrinth seal region and a guiding and wear resisting region, said labyrinth seal region including plural, spaced apart seal lands separated by circumferentially extending seal grooves, and said guiding and wear resisting region comprising a plurality of alternately lands and grooves extending axially inwardly from said skirt end surface.

13. An improved fluid turbine as defined in claim 12 wherein said retaining nut includes a support flange having upper shoulder surfaces for retaining said bell seal unit and a lower flange surface, said lower flange surface on said retaining nut being a frustoconical surface which tapers radially inwardly toward its lowermost edge.

14. An improved fluid turbine as defined in claim 13 wherein said support flange includes a plurality of slots extending between said shoulder surface and lower flange surface to provide plural passages so that said elastic fluid may pass through said slots to exert an upwardly directed force on said radial flange of said bell seal unit

15. An improved fluid turbine as defined in claim 12 having the further improvement comprising said nozzle chamber being formed with a neck portion having its upper surface defined at least in part by a circumferentially extending bevelled surface extending downwardly toward and joining the radially inner cylindrical sidewall surface of said nozzle chamber, said retaining nut including a radial flange defined by upper shoulder surfaces and a frustoconical lower surface portion, said lower nut flange frustoconical surface lying substantially parallel to said bevelled surface of said nozzle chamber neck portion.

* * * * *